United States Patent [19]

LaBate et al.

[11] Patent Number: 4,494,734

[45] Date of Patent: Jan. 22, 1985

[54] SLAG RETAINING DEVICE FOR USE DURING TAPPING OF CONVERTERS AND METHOD

[76] Inventors: Micheal D. LaBate; Michael D. LeBate, II, both of 115 Hazen Ave., Ellwood City, Pa. 16117

[21] Appl. No.: 515,998

[22] Filed: Jul. 22, 1983

[51] Int. Cl.[3] ..... C21C 5/46

[52] U.S. Cl. ..... 266/45; 266/230; 266/272; 222/590; 222/598; 222/602

[58] Field of Search ..... 266/45, 272, 287, 227, 266/236, 271, 230; 251/144, 318; 222/563, 591, 222/594, 597, 598, 602; 220/352

[56] References Cited

U.S. PATENT DOCUMENTS

| | | | |
|---|---|---|---|
| 1,237,109 | 8/1917 | Shoppe | 251/318 |
| 3,124,854 | 3/1964 | Dore | 266/272 |
| 3,459,209 | 8/1969 | Kobusch et al. | 222/602 |
| 4,390,170 | 6/1983 | Shaefer et al. | 266/272 |
| 4,462,574 | 7/1984 | Keenan et al. | 266/45 |

*Primary Examiner*—L. Dewayne Rutledge
*Assistant Examiner*—Robert L. McDowell
*Attorney, Agent, or Firm*—Harpman & Harpman

[57] ABSTRACT

A device for the separation of slag and its retention in a tapping converter which consists of a closure, sometimes referred to as a dart, arranged to be positioned, either manually or automatically, into the tap hole of the converter. The device may include configurations enabling it to seal the tap hole to prevent slag from entering the same or alternately indicate the level of the slag in the converter relative to the tap hole by restricting the tap hole and imparting a swirling motion to the molten metal and slag therein. The device may be formed of material having a specific gravity lower than that of the steel produced in the converter but higher than that of the slag or alternately having a specific gravity higher than that of the steel to facilitate manual placement of the device in the tap hole.

10 Claims, 7 Drawing Figures

SLAG RETAINING DEVICE FOR USE DURING TAPPING OF CONVERTERS AND METHOD

BACKGROUND OF THE INVENTION

1. Technical Field

This invention relates to a slag retaining device for use in tapping converters during the tapping of steel therefrom. The use of the device disclosed herein permits the tapping of steel free from slag.

2. Description of the Prior Art

Prior devices for blocking or minimizing slag carry-over when tapping molten steel from a furnace or converter are known in the art and a typical disclosure of a device requiring manual placement is seen in U.S. Pat. No. 3,459,209. Examples of prior art floatable or automatically positioned stoppers are shown in Stahl Und Eisen, Volume 90, pages 257–263.

It is an object of the present invention to overcome the disadvantages of the above-mentioned prior art and to provide an improved automatically placed floatable device for minimizing slag carry-over during tapping of molten metal from a furnace or converter and to provide a manually insertable device forming a closure having guide means and movable into the tap hole of a furnace or converter at a desired time to prevent molten slag from flowing therethrough.

SUMMARY OF THE INVENTION

The slag retaining device of the present invention is disclosed herein in two forms. The first of these is a manually insertable stopper body, sometimes called a dart, incorporating a depending guide member engagable in the tap hole and insuring the accurate placement of the stopper body of the device in closing relation to the tap hole. Alternate configurations of the stopper body increase the efficiency of the same with respect to its placement in and engagement with the tap hole, particularly when the tap hole is out of round due to erosion of the molten metal previously running therethrough. A variation of the stopper body formed with a specific gravity lower than that of the steel, but higher than that of the slag in the furnace or converter is automatically partially positioned in the tap hole where its configuration causes a swirling of the metal and slag which may be visually observed and indicates that the slag is about to reach the tap hole whereupon the tapping of the furnace or converter may be terminated.

DESCRIPTION OF THE PREFERRED EMBODIMENTS

Figure 1:
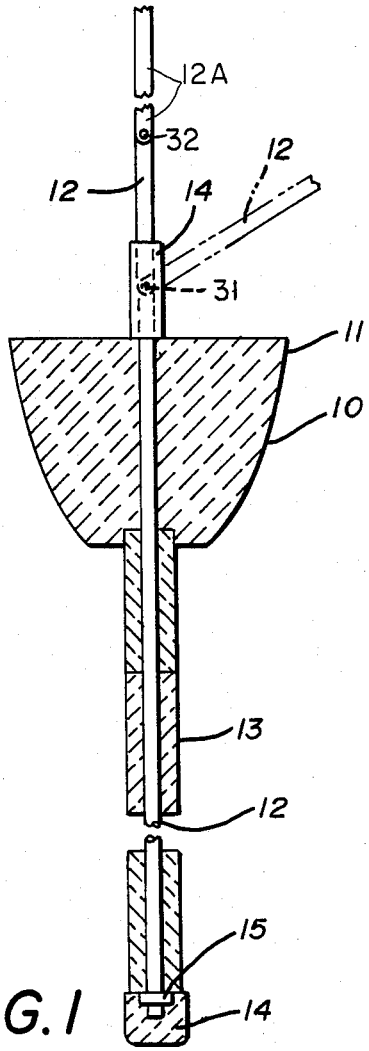
FIG. 1 is a vertical section through the manually insertable form of the slag retaining device.
Figure 2:
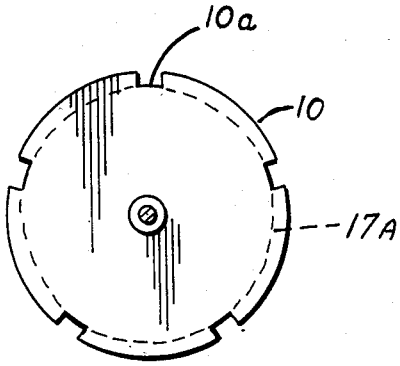
FIG. 2 is a top plan view of a portion of a slag retaining device incorporating channels formed in the exterior surface thereof.

In the form of the slag retaining device seen in FIGS. 1–4 of the drawings, a modified cone-shaped body 10 made of a fireproof material with its largest diameter 11 substantially greater than that of a tap hole in a furnace or converter in which it is to be placed is shown assembled on a steel rod 12 with the portion of the rod 12 below the body 10 enclosed in sleeves 13 of fireproof material such as a suitable refractory and including a cap 14 surrounding a fastener 15 on the lower end of the rod 12. The rod 12 extends vertically through the body 10 and upwardly and outwardly thereof and it is preferably provided with a pivot or swivel device 31 therein immediately above the upper surface of the body 10 together with a tubular member 14 slidably disposed thereon, which in the position illustrated in FIG. 1 of the drawings holds the two portions of the rod 12 in end to end alignment so that guiding motion and/or forceful downward motion may be imparted to the body 10 to manually forcefully position the body 10 in closing engagement with a tap hole in the furnace or converter with the rod 12 and sleeves 13 thereon extending below sad tap hole. In FIG. 2 a modification adds grooves 10A.

Figure 3:
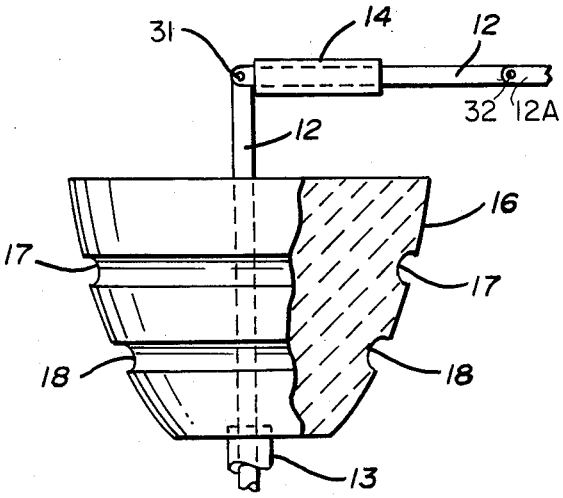
FIG. 3 is a side elevation with parts broken away of a slag retaining device with annular grooves formed in its exterior surface.
Figure 4:
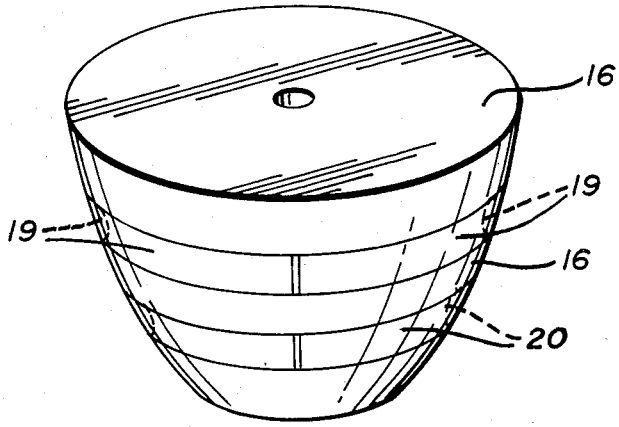
FIG. 4 is a perspective view of the device of FIG. 3 showing removable rings for forming the annular grooves seen in FIG. 3.

In FIG. 3 of the drawings, a comparable rod 12 is shown with the tubular member 14 moved above the pivot or swivel mechanism 31 so that the one portion 12 of the rod can be positioned at right angles to the other as is necessary in introducing the device into the furnace or converter through the charging opening thereof. A secondary pivot 32 on the rod 12 releasably engages a third rod 12A. When the tap hole in the furnace or converter is defined by the usual apertured refractory block, the modified conical shape of the body 10 may have a smooth surface and will seat securely in the tap hole. When the tap hole is eroded as by a considerable number of melts, it is necessary to alter the shape of the modified conical-shaped body 10 to insure its satisfactory seating in an irregular shaped tap hole. One such suggested and useable practical modification may be seen in FIG. 3 of the drawings wherein a modified conical-shaped body 16 is illustrated, partially in cross section, as having a pair of vertically spaced annular grooves 17 and 18 respectively formed therein. The annular grooves 17 and 18, which may be formed by split rings 19 and 20, each of which is of a cross sectional shape comparable with that of the shape of the grooves 17 and 18 are positioned in the mold in which the body 16 is formed and remain in the annular grooves 17 and 18 when the body 16 is removed from the mold whereupon the split rings may be opened and separated from the body 16 leaving the annular grooves 17 and 18. (FIG. 4)

Figure 5:
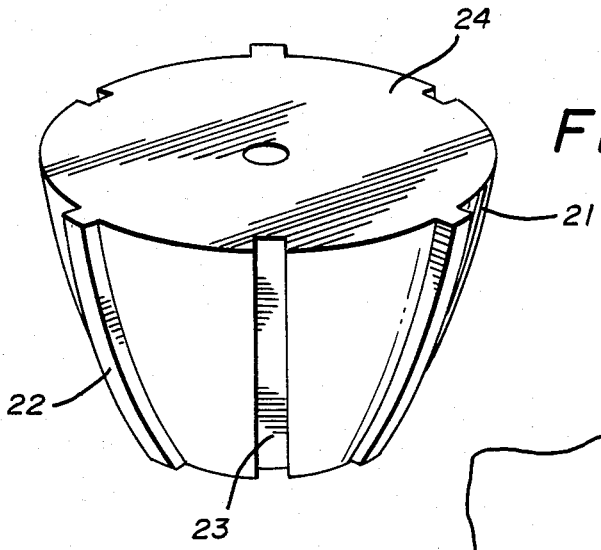
FIG. 5 is a perspective view of a modified slag retaining device having circumferentially spaced alternate grooves and ribs which enable the device to be self-positioning in a tap hole.

At such time as the tap hole in the furnace or converter is eroded to the point that a suitable closure cannot be affected by the slag retaining device hereinbefore described, a comparable device with a modified exterior configuration can be successfully used to minimize slag carry-over. Such a modification is shown in FIGS. 5,6 and 7 and by referring to FIG. 5 it will be seen that a modified conical-shaped body 21 is disclosed, the upper side thereof having a larger diameter than the lower side thereof, said upper side being larger than the largest diameter of a tap hole in a furnace or converter in which it is to be positioned automatically, and the underside thereof being of a diameter less than half the diameter of said upper side thereof.

A plurality of circumferentially spaced, alternately positioned generally vertically extending ribs 22 and grooves 23 are formed in the body 21 from its upper surface 24 to its lowermost surface 25.

Figure 6:
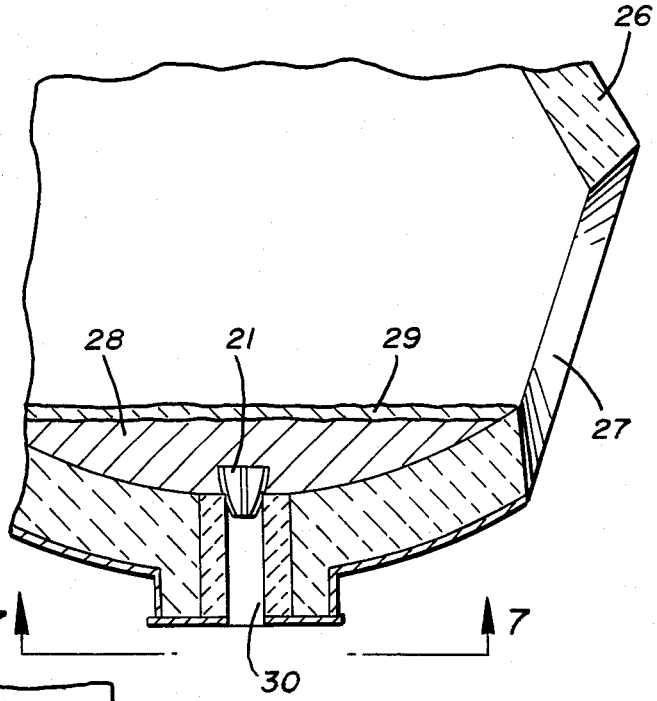
FIG. 6 is a cross sectional view of a portion of a converter showing the tap hole thereof, molten steel above the tap hole and molten slag thereon and the slag restricting device positioned in the tap hole.
Figure 7:
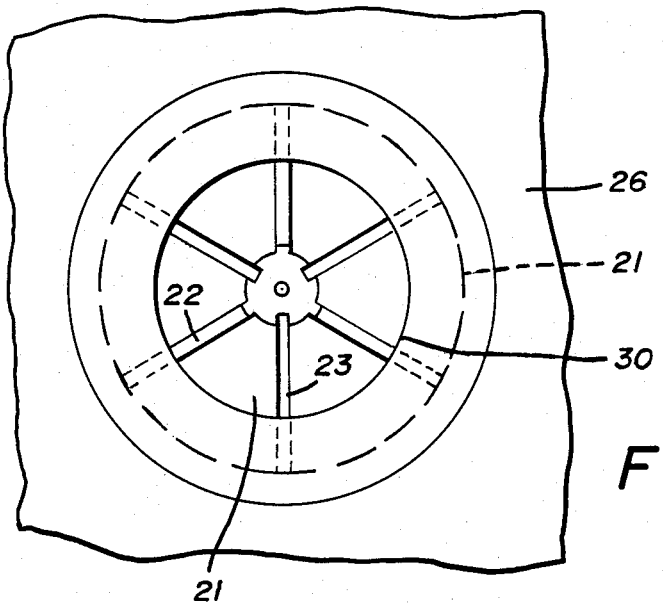
FIG. 7 is an enlarged bottom elevation on line 7—7 of FIG. 6.

In FIG. 6 of the drawings, a partial sectional view of a converter 26 is disclosed with the charging opening 27 therein in a position so that the steel 28 and the slag 29 therein will flow outwardly through a tap hole 30. The slag controlling device comprising the modified conical-shaped body 21 with its alternate ribs and grooves 22 and 23 is shown positioned partially within the tap hole 30 where it substantially reduces the flow of metal therethrough. The device of the invention is formed of material having a specific gravity lower than that of the steel in the converter but higher than that of the slag and according to this form of the invention, the modified conical shaped body 21 has its circumferentially spaced ribs 22 and grooves 23 and these may be altered to comprise a plurality of ribs about the body 21 or alternately a plurality of grooves about the body 21.

Those skilled in the art will observe that the body 21 with its ribs and/or grooves or both formed thereon is inserted into the furnace or converter just before a vortex forms as the final portion of metal starts to drain out of the tap hole. The time may be calculated from the estimated tonage of metal contained in the furnace or converter and the size and the shape of the tap hole in relation to the contents.

It is desirable that the slag controlling body 21 be introduced into the furnace or converter within a calculated time of between one to two minutes before the end of the tap when all of the metal is drained from the furnace.

The preferred density of the slag restraining body 21 for use in steel making is preferably between 0.12 to 0.22 lbs. per cubic inch. The material of the body 21 as well as the body 10 as disclosed herein is preferably substantially indissoluble in the molten metal and slag and it has a plurality of suitable configurations, which enable it to lodge in the tap hole without completely blocking the same and it is of a size comparable with the tap hole to effectively block approximately 80% of a round tap hole opening.

Those skilled in the art will observe that when the final portion of the metal starts to flow out of the furnace or converter through the tap hole, the body 21 will lodge in the tap hole causing the stream to flare since the taphole is substantially blocked. The flaring stream acts as a signal to the furnace operator that the slag will shortly flow and the operator may then shut off the flow as for example buy tilting the furnace or converter body to position the tap hole above the remaining metal and slag.

In order to form the body 21 of a suitable density as hereinbefore referred to, a suitable mix may comprise refractory cement 8 lbs., fine iron ore concentrate 16 lbs., steel shot 30 lbs., stainless steel fibers 2 lbs. and water from 3 to 5 lbs. The above formula will produce a body having a density from 0.15 to 0.17 lbs./cubic inch, although any density between that of the slag 0.10 lbs./cubic inch and that of molten steel, about 0.25 lbs./cubic inch is suitable.

It will occur to those skilled in the art, that the modified conical-shaped body 10 of the form of the invention illustrated in FIGS. 1–4 of the drawings and the body member 21 as illustrated in FIGS. 5,6 and 7 of the drawings and described hereinbefore are substantially interchangeable and may be automatically positioned by dropping them into the furnace or converter where they will position themselves in the tap hole as hereinbefore described or alternately they may be assembled on a rod with the depending guide-like extensions and manually positioned in the furnace or converter and guided and directed and forcefully positioned in the tap hole. When the body 21 of FIG. 5 of the drawings is positioned in the tap hole in the furnace or converter as seen in FIG. 6 of the drawings, an enlarged view such as seen in FIG. 7 of the drawings and taken on line 7—7 of FIG. 6 will clearly demonstrate the effectiveness of the device in minimizing the flow of metal and slag through the tap hole.

Although but four embodiments of the present invention have been illustrated and described, it will be apparent to those skilled in the art that various changes and modifications may be made therein without departing from the spirit of the invention and having thus described our invention, what we claim is:

1. A device for the retention of slag during the drawing off of steel from a tapping furnace provided with a tap hole, said device comprising a closure of a modified conical shape having a portion thereof with a maximum cross section which is slightly larger than the maximum cross section of the tap hole and a portion thereof having a cross section which is less than the maximum cross section of the tap hole so the device can be lodged into the tap hole to effectively seal said tap hole, an elongated rod positioned axially of said modified conical closure, a portion of said rod extending from the underside of said modified conical closure, refractory sleeves positioned on said rod, said rod and refractory sleeves forming guide means engagable in said tap hole for guiding said modified conical closure to engagement in said tap hole, said rod extending below said tap hole when said modified conical closure is engaged therein, said rod extending from the upper side of said modified conical closure, whereby said closure and guide means can be introduced into the furnace and moved into alignment for engagement with said tap hole.

2. The device for the retention of slag set forth in claim 1 and wherein at least one annular groove is formed in the outer surface of said closure of modified conical shape and spaced with respect to said upper side and said underside thereof.

3. The device for the retention of slag set forth in claim 1 and wherein a plurality of ribs are formed on the outer side of said closure of modified conical shape extending from the upper side thereof to the underside thereof.

4. The device for the retention of slag set forth in claim 1 and wherein a plurality of grooves are formed in the outer surface of said closure of modified conical shape extending from the upper side thereof to the underside thereof.

5. The device for the retention of slag set forth in claim 1 and wherein a plurality of alternately arranged ribs and grooves are formed in the outer surface of said closure of a modified conical shape and extending between said upper side and said underside thereof.

6. A device for the retention of slag during the drawing off of steel from a tapping furnace provided with a tap hole, said device comprising a closure of a modified conical shape of a size to effectively seat in said tap hole, said modified conical shape having an upper side of a diameter larger than the largest diameter of said tap hole and an underside of a diameter less than half the diameter of said upper side, a plurality of configurations formed in the outer surface of said closure of modified conical shape extending from said upper side to said lower side.

7. The device for the retention of slag set forth in claim 6 wherein a plurality of grooves are formed in the outer surface of said closure of modified conical shape and extend from the upper side thereof to the underside thereof and wherein said device is formed of materials resistent to dissolution in the steel and slag so as to retain minimum cross sectional dimensions greater than the tap hole opening for a time sufficient to assure the lodgement of the closure in the tap hole.

8. The device for the retention of slag set forth in claim 6 wherein a plurality of ribs are formed on the outer surface of said closure of modified conical shape and extend from the upper side thereof to the underside thereof and wherein said device is formed of materials resistent to dissolution in the steel and slag so as to retain minimum cross sectional dimensions greater than the tap hole opening for a time sufficient to assure the lodgement of the closure in the tap hole and wherein said closure has a density of about 0.12 to about 0.22 lbs. per cubic inch.

9. The method of minimizing slag carry over upon draining molten metal from a furnace through a tap hole therein, said method comprising dropping a body of modified conical shape onto the surface of molten slag and metal in said furnace within a restricted area above said tap hole so as to insure that said body will be drawn into the tap hole, said body having a plurality of generally irregular faces, the intersections of which define a portion of the body having maximum cross section which is slightly larger than the maximum dimension of the cross section of the opening of said tap hole while leaving a portion of the body with a cross section less than the maximum dimension of the cross section of the tap hole, whereby the body can be lodged into the tap hole without completely blocking the tap hole opening, said body having a guide means depending from the underside of said body to engage said tap hole for guiding said body into said tap hole, said body having a density intermediate that of the molten metal and the slag, draining molten metal from the furnace through the tap hole opening, monitoring the condition of the stream emanating from said tap hole so as to obtain an indication of flaring of said stream when said body lodges therein, and then shutting off flow through said tap hole so as to prevent carryover of slag onto the molten metal already tapped from the furnace.

10. The method of claim 9 wherein said body is substantially resistant to dissolution in the molten metal and slag so as to retain minimum cross-sectional dimensions greater than the taphole opening for a time sufficient to assure the body will lodge in the taphole opening.

* * * * *